US005509552A

United States Patent [19]

Eguchi et al.

[11] Patent Number: 5,509,552

[45] Date of Patent: Apr. 23, 1996

[54] CAPSULE FOR BOTTLE NECK

[76] Inventors: Tatsuo Eguchi; Yoshitaka Tamura, both of 61-8, Sasatani, Yamaderacho, Kusatsu-shi, Shiga, 525; Toshihiro Ueda, 14-114, Shimohozumi 4-chome, Ibaraki-shi, Osaka 567, all of Japan

[21] Appl. No.: 501,519

[22] Filed: Jul. 12, 1995

Related U.S. Application Data

[63] Continuation of Ser. No. 208,104, Mar. 8, 1994, abandoned.

[30] Foreign Application Priority Data

Mar. 17, 1993 [JP] Japan ..... 5-019247 U

[51] Int. Cl.[6] ..... B65D 41/32

[52] U.S. Cl. ..... 215/256; 215/251; 215/254; 215/258

[58] Field of Search ..... 215/251, 254, 215/246, 256, 258, 273, 277; 229/202

[56] References Cited

U.S. PATENT DOCUMENTS

| | | | |
|---|---|---|---|
| 1,481,035 | 1/1924 | Stattmann | 215/251 |
| 1,875,431 | 9/1932 | Fabrice | 215/251 |
| 2,806,620 | 9/1957 | Blanch | 215/251 |
| 3,809,365 | 5/1974 | Loffler | 215/277 X |
| 4,000,824 | 1/1977 | Han | 215/232 |
| 4,127,209 | 11/1978 | Ritzenhoff | 215/254 |
| 4,506,797 | 3/1985 | Bullock, III | 215/256 |
| 4,784,296 | 11/1988 | Bullock | 215/256 X |
| 5,012,942 | 5/1991 | Druesne et al. | 215/253 |
| 5,103,989 | 4/1992 | Druesne et al. | 215/254 |
| 5,207,783 | 5/1993 | Burton | 215/256 |

FOREIGN PATENT DOCUMENTS

WO93/02936 2/1993 WIPO .

*Primary Examiner*—Gary E. Elkins
*Attorney, Agent, or Firm*—Jones, Tullar & Cooper

[57] ABSTRACT

A capsule having a cap portion may be torn together with a pulling tab for tearing. The capsule comprises the cap portion and a skirt portion. Two weakening lines for tearing the cap portion are provided between the cap portion and the skirt portion. One of the weakening lines on the cap portion side is inclined to a top of the cap portion with a certain inclination as it approaches near the tear-terminating end. When pulling the pulling tab outwardly, the cap portion is torn along the weakening lines. Then, as it approaches near the tear-terminating end, the cap portion is torn upward toward the top, thereby opening the cap portion. Thus, the cap portion is removed from a cap of a bottle together with the pulling tab in one unit.

6 Claims, 3 Drawing Sheets

FIG. 1
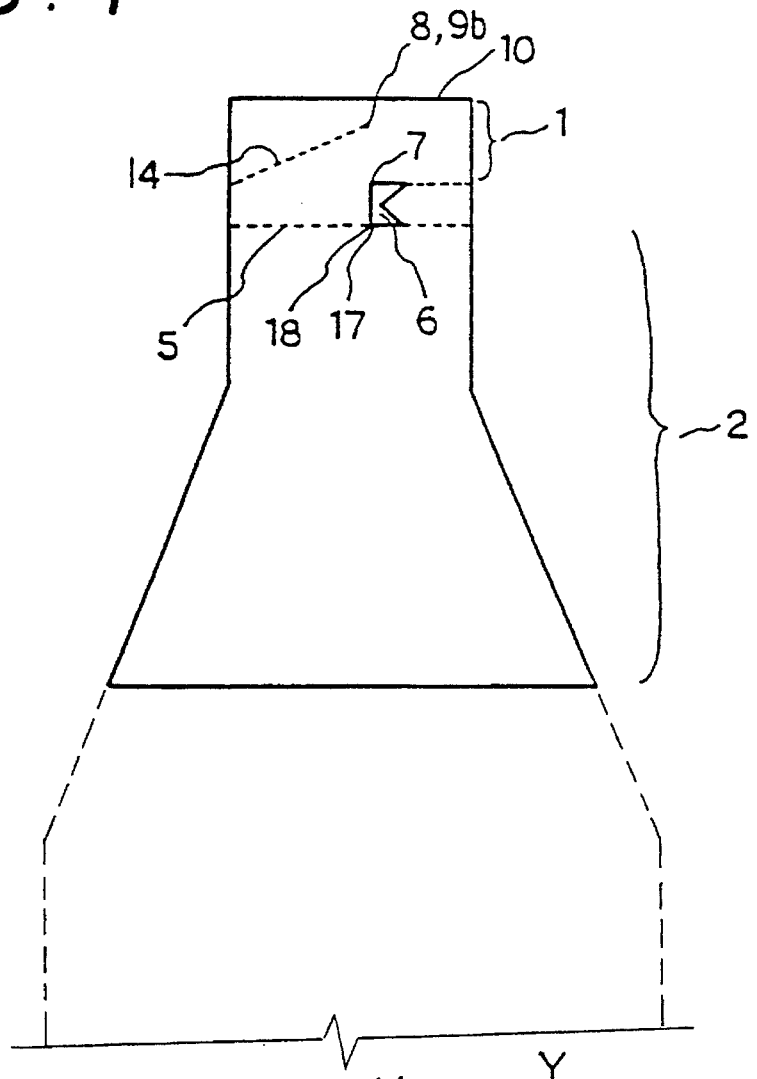
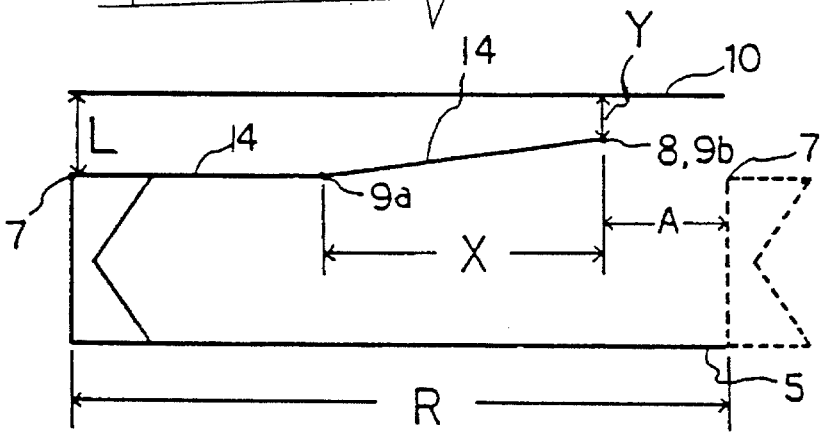
FIG. 2

CAPSULE FOR BOTTLE NECK

This is a continuation of application Ser. No. 08/208,104 filed on Mar. 8, 1994, ABN.

BACKGROUND OF THE INVENTION

The present invention relates to a capsule of the kind used to cover the upper portion of the neck of a bottle, the mouth of which has been closed by a cork, screw-cap, bung or other form of closure. The exposed parts of the capsule provide a tamper-evidence cover for the bottle, and an ornamental addition to the bottle.

More particularly, according to the present invention, there is provided a bottle having a neck, the mouth of which is closed by a bung, cork, screw-cap or other form of closure, the upper portion of the neck of the bottle and the exposed portion of the applied closure being covered by a capsule formed from a material such as lead, an alloy of tin and lead, tin, aluminum or any of these materials laminated with a synthetic resin film, the sides of the capsule being deformed inwardly into close contact with the surface of the neck of the bottle and any exposed laterally-facing surface of the closure, whereby the capsule is retained on the closure and provides a tamper-evident cover for the closure.

Hitherto, as illustrated in FIG. 5, a capsule comprises a cap portion 1, a skirt portion 2, and a tearable guarantee strip 3 connecting the cap portion 1 and the skirt portion 2. Weakening lines 4 and 5 are provided, respectively, at a boundary between the tearable guarantee strip 3 and the cap portion 1, and at a boundary between the tearable guarantee strip 3 and the skirt portion 2. The weakening lines 4 and 5 generally extend ground the circumference of the capsule by compressing a capsule body with a cutting knife in the direction of thickness like a perforation. A pulling tab 6 is also formed on one end of the tearable guarantee strip 3 for starting the removal by tearing. Accordingly, when pulling the tab 6 formed on the tearable guarantee strip 3 outwardly in the circumferential direction of the bottle, the tearable guarantee strip 3 is gradually torn and removed along the weakening lines 4 and 5 from the tear starting ends 7, 17 toward the tear terminating ends 8, 18 due to less strength of these lines formed compressively like a perforation. After completely removing the tearable guarantee strip 3 and the cap portion 1, the bottle is unsealed or open.

A problem, however, exists in that, at the time of removing the metallic capsule by manually pulling up the cap portion 1, it is possible for one's fingers to feel pain or to be injured due to burrs (projections with sharp edges) formed on the torn edge of the cap portion 1. This problem has recently been recognized as a result of the introduction of soft tin or soft aluminum employed for the capsule material.

To overcome this problem, there has been proposed for preventing the tearable edge of the cap portion 1 and the skirt portion 2 from producing burrs a variation, as disclosed in the International Publication No. WO 93/02936. This variation resides in the arrangement of individual compressed parts each forming the weakening lines 4 and 5, in such a manner that it becomes difficult to produce burrs on the tearable edges of the skirt portion 2 and the cap portion 1.

SUMMARY OF THE INVENTION

It is proposed that if the tearable guarantee strip 3 and the cap portion 1 are removed together in one unit without being separated from each other, it is no longer necessary to pick-up only the cap portion 1 manually using one's fingers. This would result in one's fingers not feeling pain and/or being insured.

The present invention therefore, developed to solve the above-discussed problem and has as an object the provision of an improved capsule in which the tearable guarantee strip 3 and the cap portion 1 are removed together in one unit simply by varying the arrangement of the weakening lines without changing the manner of the compression in the individual compressed parts each forming the weakening lines.

To accomplish the foregoing object, the capsule according to the invention comprises a cap portion and a skirt portion, and a pulling tab and weakening lines for removal of the cap portion, the weakening lines being provided between the cap portion and the skirt portion, characterized in that one weakening line is provided with an inclined part and a tear-starting end to a tear-terminating end, the inclined part satisfying an expression $\{(L-Y)/X)\}<0.7$ (where: $0<X\leqq R$: $0\leqq Y<L$; "L" indicates the shortest distance from the tear-starting end of the weakening line to a top of the cap portion; "Y" indicates the shortest distance from the tear-terminating end of the weakening line to the top of the cap portion; "X" indicates a distance in the circumferential direction from an inclination-starting point of the weakening line to an inclination-terminating point thereof; and "R" indicates a circumferential length of the other weakening line.

There is also provided according to the present invention a capsule in which the inclination-terminating point of the inclined part is coincident with the tear-terminating end of the weakening line, and the capsule in which a part of the weakening line extending from the tear-starting end to the inclination-starting point is parallel to the other weakening line. There is further provided according to the present invention a capsule in which a part of the weakening line extending from the inclination-terminating point to the tear-terminating end is parallel to the other weakening line.

BRIEF DESCRIPTION OF THE DRAWINGS

FIG. 1 is a front view illustrating a capsule according to an example of the present invention;

FIG. 2 is a developed view illustrating a tearable guarantee part of a capsule according to an example of the present invention;

DETAILED DESCRIPTION OF THE PREFERRED EMBODIMENTS

Figure 5:
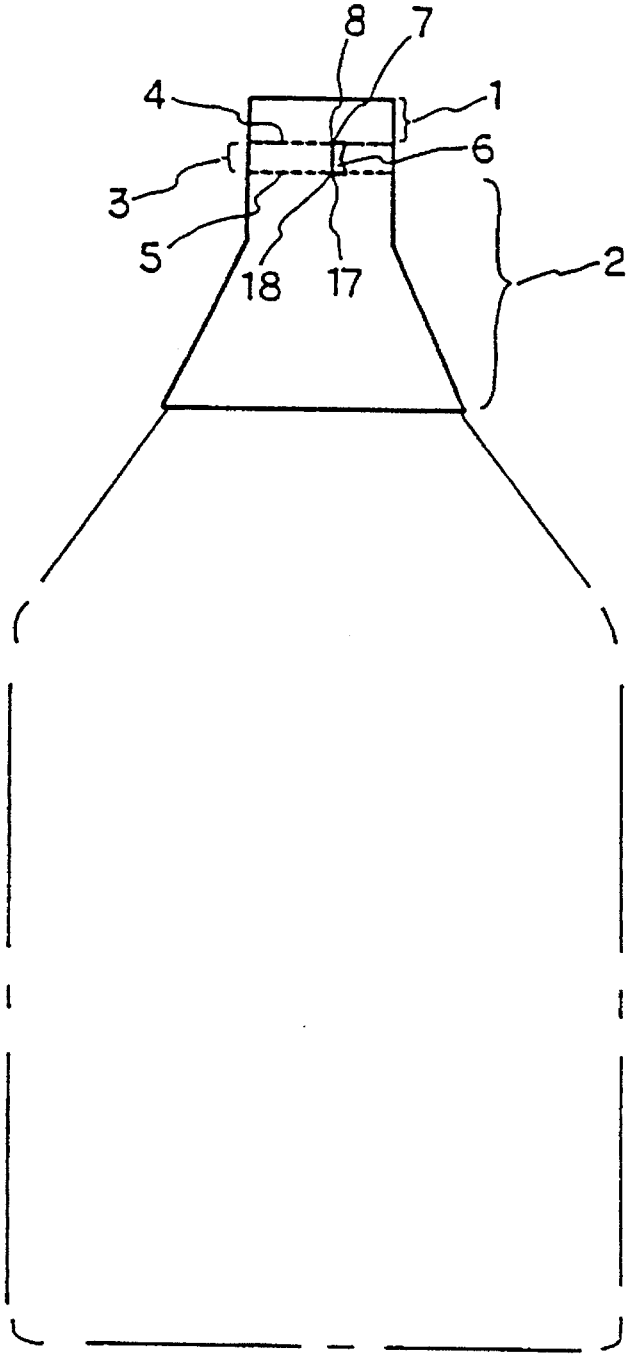
FIG. 5 (PRIOR ART)
FIG. 5 is a front view of a capsule according to the prior art.

As illustrated in FIG. 1, the capsule according to the present invention comprises a cap portion 1 for sealing a bottle, and a skirt portion 2 for sealing the upper portion of the bottle neck. Thus, the portion corresponding to the conventional tearable guarantee strip 3 (FIG. 5) is solidly united with the cap portion 1 forming one body. As a result there is substantially no independent tearable guarantee strip. The cap portion 1 and the skirt portion 2 are formed into a shape corresponding to the cap and neck of the bottle so as to comply with a shape of the bottle, and have a hollow interior. The cap portion 1 is a cylinder with a bottom, while the skirt portion 2 is partly a cylinder and partly frustoconical both without a bottom, corresponding to the shape of the bottle which is generally cylindrical.

As illustrated in FIG. 1, the capsule according to the present invention is provided with weakening lines 14 and 5. The weakening line 5 is arranged in the same manner as the conventional capsule. On the other hand, the weakening line 14 is newly arranged in a manner different from the conventional capsule. The present invention is characterized by this peculiar arrangement of the weakening line 14. That is, the weakening line 14 is arranged in such a manner as to meet the expression $\{(L-Y)/X\}<0.7$. This expression is hereinafter described with reference to FIGS. 2 and 3 which are both developed views of the tearable guarantee part of the capsule.

In the expression, "L" indicates the shortest distance from the tear-starting end 7 of the weakening line 14 to the top 10 of the cap portion 1. Generally, "L" is a distance in the range of several mm to several tens of mm.

"Y" indicates the shortest-distance from the tear-terminating end 8 of the weakening line 14 to the top 10 of the cap portion 1. As illustrated, the weakening line 14 is inclined toward the tearing direction and, therefore, the value of "Y" is smaller than that of "L". In this respect, there is a case of Y=0 because the tear-terminating end 8 may reach the top 10 of the cap portion 1. Accordingly, "Y" may be expressed by $0 \leqq Y < L$.

"X" indicates a distance in the circumferential direction from the inclination-starting point **9*a* of the weakening line 14 to the inclination-terminating point 9*b* thereof. Because the inclination-starting point 9*a* may be established anywhere on the weakening line 14, "X" may be expressed by $0<X \leqq R$. There is no case of X=0 because X=0 results in Y=L which means the weakening line 14 is not inclined at all. There is a case of X=R because the inclination-starting point 9*a* may be coincident with the tear-starting end 7 of the weakening line 14**. "X" is usually in the range of 5 to 100 mm depending upon the length of "L".

"R" indicates a circumferential length of a portion where the weakening line 5 is provided on the capsule. More specifically, "R" is coincident with a circumferential length of the weakening line 5.

"A" indicates a distance in the circumferential direction from the tear-terminating end 8 to the tear-starting end 7. Thus, A>0 in accordance with. FIG. 2, while A=0 in accordance with FIG. 3. In both cases, the inclination-terminating point **9*b* is coincident with the tear-terminating end 8. After all, "X" is a distance in the circumferential direction from the inclination-starting point 9*a* of the weakening line 14 to the tear-terminating end 8** thereof.

In the present invention, the weakening line 14 is not provided with any inclination satisfying an expression of $\{(L-Y)/X\} \geqq 0.7$ for the following reason. That is, if providing such an inclination, there arises a disadvantage such that the inclined part of the weakening line 14 will be excessively inclined to the top 10 side of the cap portion 1, making it impossible to tear along the weakening lines 14 and 5. Accordingly, any portion other than the weakening lines 14 and 5 will be obliged to be torn, eventually resulting in difficulty of tearing the cap portion 1. There arises another disadvantage such that the distance in the circumferential direction from the inclination-starting point **9*a* to the inclination-terminating point 9*b* will be excessively shortened, making it impossible to tear the entire cap portion 1 as a whole. Accordingly, the cap portion 1** will be obliged to be removed manually by fingers in the conventional manner.

Figure 4:
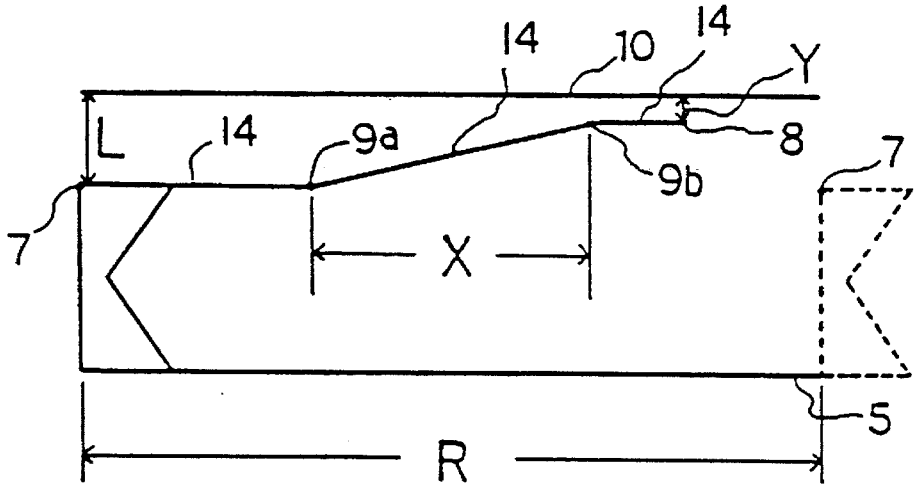
FIG. 4 is a developed view illustrating a tearable guarantee part of a capsule according to a further example of the present invention.

The weakening line 14 has an inclined part which inclines to the top 10 of the cap portion 1, and in which it is satisfied that the inclination-terminating point **9*b* or the tear-terminating end 8 is arranged so as to either reach the top 10 or extend up to several mm under the top 10. For removal along the weakening line 14 having the inclined part together with the weakening line 5 having no inclined part, it is useful to form a guide for a tearing operation along the weakening line 14 by arranging the portion extending from the tear-starting end 7 to the inclination-starting point 9*a* of weakening line 14 to be in parallel to the weakening line 5, though it depends upon the steepness of the inclination. It is also useful to form a guide for terminating the tearing operation along the weakening line 14 by arranging the portion extending from the inclination-terminating point 9*b* to the tear-terminating end 8 of the weakening line 14 to be parallel to the weakening line 5, as illustrated in FIG. 4**.

Figure 3:
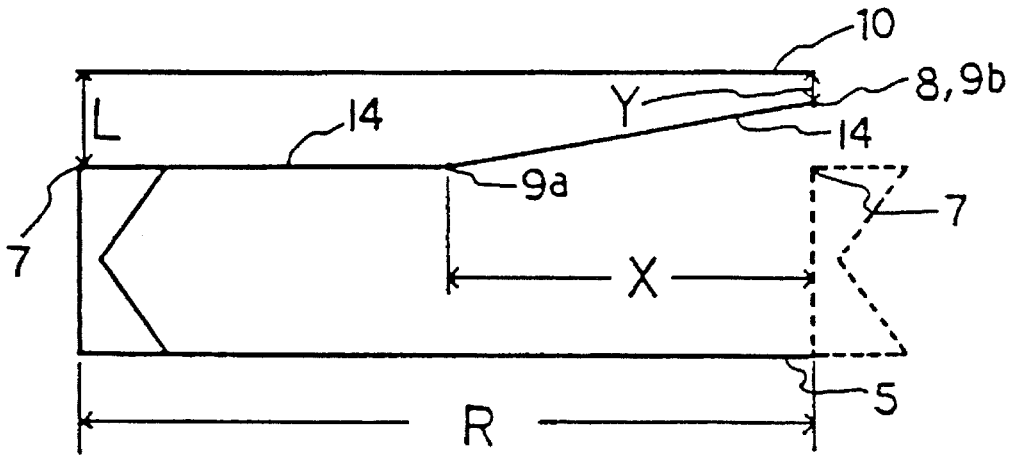
FIG. 3 is a developed view illustrating a tearable guarantee part of a capsule according to another example of the present invention.

The tear-terminating end 8 of the weakening line 14 may be located at any position spaced from the tear-starting end 7. Accordingly, the tear-terminating end 8 may be located either on the vertical line of the tear-starting end 7, as illustrated in FIG. 3 or separately from the vertical line as illustrated in FIGS. 2 and 4. In addition, because the pulling tab 6 for tearing may be actually formed either with a cutout portion or with a-shaped slit and, for the convenience of explanation, the tear-starting end 7 according to the present invention is understood to be the one provided with such a cutout portion and located at the left end.

The configuration of the individual compressed parts each forming the weakening lines 14 and 5 may be freely selected from among well-known saw-tooth-like compressed parts, those formed in combination with linear compressed parts and saw-tooth-like compressed parts or perforations, circular arc compressed parts, or perforations, as disclosed in the International Publication WO 93/02936. Compressed parts formed by a conventional perforation-like configuration in combination with any of the mentioned compressed parts is also possible.

As for the material of the capsule, tin only or a tin alloy is mainly used. It is also satisfactory to use aluminium only or aluminum alloy. Of course, the conventionally used lead only or lead alloy can also be also employed as the material. It is further satisfactory to use any of these materials coated with a synthetic resin film. A capsule exclusively composed of a synthetic resin (i.e., plastic capsule) is also satisfactory for in the present invention.

BEST MODE FOR CARRYING OUT THE INVENTION

Examples 1 to 18 and Comparative Examples 1 to 5:

Capsules each having weakening lines 14 and 5 as illustrated in FIGS. 2 and 3 were prepared by using a tin foil of 300 μm in thickness as illustrated in FIG. 1. A depth of the individual compressed parts each forming the weakening lines 14 and 5 was set to be 0.2 mm, and the values of the noted reference symbols "R", "L", "Y", "X", etc. are as indicated in Table 1. The capsules of the above construction were then subjected to a test for determining whether or not the cap portion thereof was simultaneously removed together with the pulling tab for unsealing or opening the capsules. A three-grade evaluation was adopted by marking with "○", "X", and "Δ". That is, "○" indicates an evaluation of a capsule which was smoothly unsealed such that the cap portion was simultaneously removed together with the pulling tab. "X" indicates an evalution of a capsule of which the cap portion was not removed together with the pulling tab. This was because a tearing direction got out of the weakening line of the inclined-part due to an excessively large inclination. "Δ" indicates an evaluation of a capsule in which the mentioned evaluations "○" and "X" were found almost evenly. Table 1 shows the results.

It is understood from Tables 1 and 2 that, in the capsules of Examples 1 to 22, the pulling tab and the cap portion were simultaneously removed together as one unit. On the other hand, in the capsules of the Comparative Examples, the pulling tab and the cap portion were not torn along the weakening line 14 due to the excessively large inclination, but torn at a portion out of the weakening line, thus making it difficult to tear the cap portion.

TABLE 1

| | R (mm) | L (mm) | Y (mm) | L–Y (mm) | A (mm) | X (mm) | (L:Y)/X | Evaluation |
|---|---|---|---|---|---|---|---|---|
| Examples | | | | | | | | |
| 1 | 100 | 6 | 0 | 6 | 0 | 95 | 0.063 | ○ |
| 2 | 100 | 6 | 5 | 1 | 0 | 95 | 0.011 | ○ |
| 3 | 100 | 6 | 0 | 6 | 0 | 80 | 0.075 | ○ |
| 4 | 100 | 6 | 2 | 4 | 0 | 80 | 0.500 | ○ |
| 5 | 100 | 8 | 0 | 8 | 0 | 80 | 0.100 | ○ |
| 6 | 100 | 8 | 2 | 6 | 0 | 9 | 0.667 | ○ |
| 7 | 100 | 10 | 2 | 8 | 0 | 20 | 0.400 | ○ |
| 8 | 100 | 10 | 2 | 8 | 0 | 25 | 0.320 | ○ |
| 9 | 100 | 10 | 2 | 8 | 0 | 50 | 0.160 | ○ |
| 10 | 100 | 10 | 5 | 5 | 0 | 60 | 0.083 | ○ |
| 11 | 100 | 10 | 5 | 5 | 0 | 75 | 0.067 | ○ |
| 12 | 100 | 10 | 5 | 5 | 0 | 80 | 0.063 | ○ |
| 13 | 100 | 10 | 0 | 10 | 0 | 100 | 0.100 | ○ |
| 14 | 100 | 10 | 2 | 8 | 0 | 100 | 0.080 | ○ |
| 15 | 100 | 10 | 5 | 5 | 0 | 100 | 0.050 | ○ |
| 16 | 100 | 8 | 1 | 7 | 13 | 57 | 0.123 | ○ |
| 17 | 100 | 10 | 3 | 7 | 13 | 57 | 0.123 | ○ |
| 18 | 100 | 10 | 4 | 6 | 5 | 70 | 0.086 | ○ |
| Comparative Examples | | | | | | | | |
| 1 | 100 | 6 | 2 | 4 | 0 | 5 | 0.800 | X |
| 2 | 100 | 10 | 2 | 8 | 0 | 10 | 0.800 | X |
| 3 | 100 | 10 | 0 | 10 | 0 | 10 | 1.000 | X |
| 4 | 100 | 10 | 3 | 7 | 0 | 10 | 0.700 | Δ |
| 5 | 100 | 10 | 1 | 9 | 5 | 10 | 0.900 | X |

Examples 19 to 22 and Comparative Examples 6 to 7:

The same capsules as those of the Examples 1 to 18, except that they were provided with the weakening lines 14 and 5 as illustrated in FIG. 4. These were prepared and the performances thereof were evaluated in the same manner as for Examples 1 to 18. Table 2 shows the results. In Table 2, the tear starting parallel portion indicates a length (mm) of a part being parallel to the weakening line 5 extending from the tear-starting end 7 to the tear-inclination starting point 9*a*, and the tear-terminating parallel portion indicates a length (mm) of a part being parallel to the weakening line 5 extending from the inclination terminating point 9*b* to the tear-terminating end 8.

As has been described so far, in the capsule of the above construction and arrangement according to the present invention, the weakening line 14 on the cap portion 1 side has a specific inclination as it goes near the tear-terminating end 8, thereby forming an inclined part toward the top 10. Accordingly, when pulling the pulling tab 6 outwardly, the cap portion 1 is torn first along the weakening line 14, and then as it is getting near the tear-terminating end 8, the cap portion 1 is torn upwardly to the top 10 of the cap portion 1. Thus, the cylindrical cap portion is opened without a separation of the pulling tab 6 and the cap portion 1 during the tearing operation, and after completing the tearing operation, the cap portion 1 can be easily removed upward from the cap of the bottle together with the pulling tab 6. In other

TABLE 2

| | R (mm) | Tear starting parallel portion | L mm | Y mm | L–Y (mm) | X mm | (L–Y)/X | Tear terminating parallel portion | A mm | Evalution |
|---|---|---|---|---|---|---|---|---|---|---|
| Examples | | | | | | | | | | |
| 19 | 100 | 15 | 10 | 4 | 6 | 70 | 0.086 | 5 | 5 | ○ |
| 20 | 100 | 15 | 10 | 5 | 5 | 70 | 0.071 | 5 | 5 | ○ |
| 21 | 100 | 15 | 8 | 2 | 6 | 70 | 0.086 | 5 | 5 | ○ |
| 22 | 100 | 15 | 8 | 2 | 6 | 75 | 0.080 | 5 | 0 | ○ |
| Comparative Examples | | | | | | | | | | |
| 6 | 100 | 80 | 10 | 2 | 8 | 10 | 0.800 | 5 | 5 | X |
| 7 | 100 | 15 | 12 | 2 | 10 | 10 | 1.000 | 75 | 0 | X |

words, it is not necessary to touch the cap portion 1 since the cap portion 1 can be removed just by pulling the pulling tab 6 with one's fingers, and therefore there no longer exist the disadvantage that one's fingers touch the burrs formed on the torn edge of the cap portion 1. As a result, a remarkable advantage is achieved such that there is substantially no possibility of feeling pain in one's fingers or injuring any finger at the time of unsealing a bottle.

Another peculiar advantage is such that since the cap portion 1 is torn together with the pulling tab 6 as one unit (i.e., there is no conventional tearable guarantee strip), there no longer exists the problem of tearing off the tearable guarantee strip on the midway of the unsealing operation.

What is claimed is:

1. A capsule, comprising: a cap portion having a top; a skirt portion; weakening lines; and a pulling tab connected to the cap portion, the skirt portion and the weakening lines for removal of the cap portion from the skirt portion, wherein one of said weakening lines is provided with a tear-starting end and a tear-terminating end, and defines a longitudinally inclined part between said tear-starting end and said tear-terminating end, said inclined part satisfying the expression:

$$\{(L-Y)/X\}<0.7,$$

where: $0<X\leqq R$; $0\leqq Y<L$; "L" indicates the shortest distance from said tear-starting end to the top of the cap portion; "Y" indicates the shortest distance from said tear-terminating end to the top of the cap portion; "X" indicates a distance in the circumferential direction from an inclination-starting point of said one of said weakening lines to an inclination-terminating point thereof; and "R" indicates a circumferential length of said other weakening line.

2. A capsule as set forth in claim 1, wherein said inclination-terminating point is coincident with said tear-terminating end.

3. A capsule as set forth in claim 1, wherein a part of said one of said weakening lines extending from said tear-starting end to said inclination-starting point is parallel to said other weakening line.

4. A capsule as set forth in claim 2, wherein a part of said one of said weakening lines extending from said tear-starting end to said inclination-starting point is parallel to said other weakening line.

5. A capsule as set forth in claim 1, wherein a part of said one of said weakening lines extending from said inclination-terminating point to said tear-terminating end is parallel to said other weakening line.

6. A capsule as set forth in claim 3, wherein a part of said one of said weakening lines extending from said inclination-terminating point to said tear-terminating end is parallel to said other weakening line.

* * * * *